US011702758B2

(12) United States Patent
Lang

(10) Patent No.: US 11,702,758 B2
(45) Date of Patent: Jul. 18, 2023

(54) ELECTROPLATING DEVICE AND ELECTROPLATING METHOD

(71) Applicant: Simetric Semiconductor Solutions Co., Ltd., Guangdong (CN)

(72) Inventor: Marcus Elmar Lang, Guangdong (CN)

(73) Assignee: Simetric Semiconductor Solutions Co., Ltd., Shenzhen (CN)

( * ) Notice: Subject to any disclaimer, the term of this patent is extended or adjusted under 35 U.S.C. 154(b) by 0 days.

(21) Appl. No.: 17/864,457

(22) Filed: Jul. 14, 2022

(65) Prior Publication Data

US 2022/0349081 A1 Nov. 3, 2022

Related U.S. Application Data

(63) Continuation of application No. PCT/CN2021/137064, filed on Dec. 10, 2021.

(30) Foreign Application Priority Data

Jan. 19, 2021 (CN) ..... 202110071104.1

(51) Int. Cl.
*C25D 17/10* (2006.01)
*C25D 5/08* (2006.01)
*C25D 5/20* (2006.01)

(52) U.S. Cl.
CPC ..... *C25D 5/08* (2013.01); *C25D 5/20* (2013.01); *C25D 17/10* (2013.01)

(58) Field of Classification Search
None
See application file for complete search history.

(56) References Cited

U.S. PATENT DOCUMENTS 5,830,334 A * 11/1998 Kobayashi ..... C25D 5/08 204/224 R
6,685,817 B1 * 2/2004 Mathieu ..... C25D 17/001 257/E23.024

(Continued)

FOREIGN PATENT DOCUMENTS

CN 1174249 A 2/1998
CN 2403792 Y 11/2000

(Continued)

OTHER PUBLICATIONS

1st Office Action of counterpart Chinese Patent Application No. 202110071104.1 dated Jul. 29, 2021.

(Continued)

*Primary Examiner* — Stefanie S Wittenberg

(57) ABSTRACT

An electroplating device and an electroplating method, the electroplating device includes an electroplating unit for electroplating a production panel. The electroplating unit includes an electrolyte channel for jetting an electrolyte toward the production panel, and an electroplating assembly disposed on an outer surface of the electrolyte channel. The electroplating assembly includes an anode disposed on the outer surface of the electrolyte channel, and a suction channel in the anode which is used for absorbing the electrolyte in a direction opposite to a jet-plating direction. The electrolyte may be uniformly distributed on the production panel by the combination of the electrolyte channel and the electroplating assembly.

15 Claims, 4 Drawing Sheets

(56) References Cited

U.S. PATENT DOCUMENTS

| | | | | |
|---|---|---|---|---|
| 2011/0155563 | A1* | 6/2011 | Ravkin | C25D 5/22 204/224 R |
| 2016/0273119 | A1* | 9/2016 | He | C25D 17/001 |
| 2022/0220628 | A1* | 7/2022 | Rose | C25D 17/14 |

FOREIGN PATENT DOCUMENTS

| | | | |
|---|---|---|---|
| CN | 101023204 | A | 8/2007 |
| CN | 102181895 | A | 9/2011 |
| CN | 103025922 | A | 4/2013 |
| CN | 103590080 | A | 2/2014 |
| CN | 107012489 | A | 8/2017 |
| CN | 110886004 | A | 3/2020 |
| JP | H1060684 | A | 3/1998 |

OTHER PUBLICATIONS

Notice of Allowance of counterpart Chinese Patent Application No. 202110071104.1 dated Aug. 19, 2021.

* cited by examiner

ELECTROPLATING DEVICE AND ELECTROPLATING METHOD

The present application is a continuation application of PCT/CN2021/137064, filed on Dec. 10, 2021 which claims priority from Chinese patent application No. 202110071104.1 filed on Jan. 19, 2021, the entire contents of which are incorporated herein by reference.

TECHNICAL FIELD

The present application relates to the technical field of electroplating, and in particular, to an electroplating device and an electroplating method.

BACKGROUND TECHNOLOGY

There have been increasing requirements for electroplating (especially copper plating) in the field of manufacturing of IC substrates. The technical challenge arises from performing efficient electroplating on microstructures on a smaller and smaller scale such as conductive traces or copper bumps. Additionally, in order to meet the requirements of mass production, it is also necessary to consider how to uniformly distribute copper on the entire production panel, besides attaching enough copper on the structures with reducing sizes.

To ensure that the microstructure is fully immersed in the electrolyte for sufficient exchange efficiency, large-scale chemical reaction cells have emerged on the market, for example, some equipped with full-surface extraction devices. However, for each substrate product that is individually designed, the uniformity of the electrolyte or the ability to independently adjust reaction across the production panel cannot be achieved as expected.

SUMMARY

An embodiment of the present application provides an electroplating device and an electroplating method, aiming at obtaining uniform plating on the production panel.

An embodiment of the present application provides an electroplating device, including an electroplating unit for electroplating a production panel. The electroplating unit includes an electrolyte channel for jetting an electrolyte toward the production panel, and an electroplating assembly disposed on an outer surface of the electrolyte channel. The electroplating assembly includes an anode disposed on the outer surface of the electrolyte channel, and a suction channel provided in the anode which is used for absorbing the electrolyte in a direction opposite to a jet-plating direction.

Further, the electroplating assembly is movably disposed on the outer surface of the electrolyte channel to adjust a distance between the electroplating assembly and the production panel.

Further, an outer surface of the anode is coated with a shielding coating.

Further, a plurality of suction channels are provided, and the plurality of suction channels are disposed at an equal interval in the anode.

Further, the number of the suction channel is one, and the suction channel is arranged in an annular shape in the anode.

Further, a diffuser is disposed between the electroplating unit and the production panel.

Further, the electroplating device includes a plurality of electroplating modules, each one of the plurality of electroplating modules consists of a plurality of electroplating units.

Further, the electroplating device includes an electrolyte tank and a circulating pump, the electrolyte tank is in communication with the electrolyte channel, one end of the circulating pump is communicated with the suction channel, and the other end of the circulating pump is communicated with the electrolyte tank.

Further, the electroplating device also includes an oscillation frame for placing the production panel.

An embodiment of the present application further provides an electroplating method using the electroplating device according to any of the above, the electroplating method includes:

setting a jet-plating distance for each of the electroplating units in the electroplating device according to a predetermined electroplating distance;

placing a production panel to be electroplated on the oscillation frame of the electroplating device, and carrying out jet-plating process of the production panel through the electrolyte channel;

forcing the production panel to be electroplated to oscillate, at an oscillation frequency of 0.1-100 Hz, by the oscillation frame during jet-plating.

The embodiment of the present application provides an electroplating device and an electroplating method. The electroplating device, includes an electroplating unit for electroplating a production panel. The electroplating unit includes an electrolyte channel for jetting an electrolyte toward the production panel, and an electroplating assembly disposed on an outer surface of the electrolyte channel. The electroplating assembly includes an anode disposed on the outer surface of the electrolyte channel, and a suction channel provided in the anode which is used for absorbing the electrolyte in a direction opposite to a jet-plating direction. In the embodiment of the present application, the electrolyte channel and the electroplating assembly are used in combination, so that the electrolyte can be uniformly plated on the production panel.

BRIEF DESCRIPTION OF THE DRAWINGS

In order to explain the technical proposals of the embodiments of the present application more clearly, the drawings mentioned in the description of the embodiments will be briefly described. Apparently, the drawings described below are some embodiments of the present application, those skilled in the art can obtain other drawings based on these drawings without creative work.

DESCRIPTION OF THE EMBODIMENTS

The technical proposals in the embodiments of the present application will be clearly and completely described in conjunction with the accompanying drawings in the embodiments of the present application. Apparently, the described embodiments are some of the embodiments of the present application, rather than all of them. Based on the embodiments in the present application, all other embodiments obtained by those skilled in the art without creative work shall fall within the scope of protection of the present application.

It should be understood that when used in the specification and the appended claims, the terms "including" and "comprising" indicate the existence of the described features, integers, steps, operations, elements and/or components, but do not exclude the existence or addition of one or more other features, integers, steps, operations, elements, components, and/or collections thereof.

It should also be understood that the terms used in the specification of the present application are only for describing the specific embodiments and are not intended to limit the application. As used in the specification and the appended claims of the present application, unless indicated otherwise in the context, the singular forms "a", "an" and "the" are intended to include plural forms.

It should be further understood that the term "and/or" used in the specification and appended claims of the present application refers to any and all possible combinations of one or more of the associated listed items, and includes these combinations.

Figure 1:
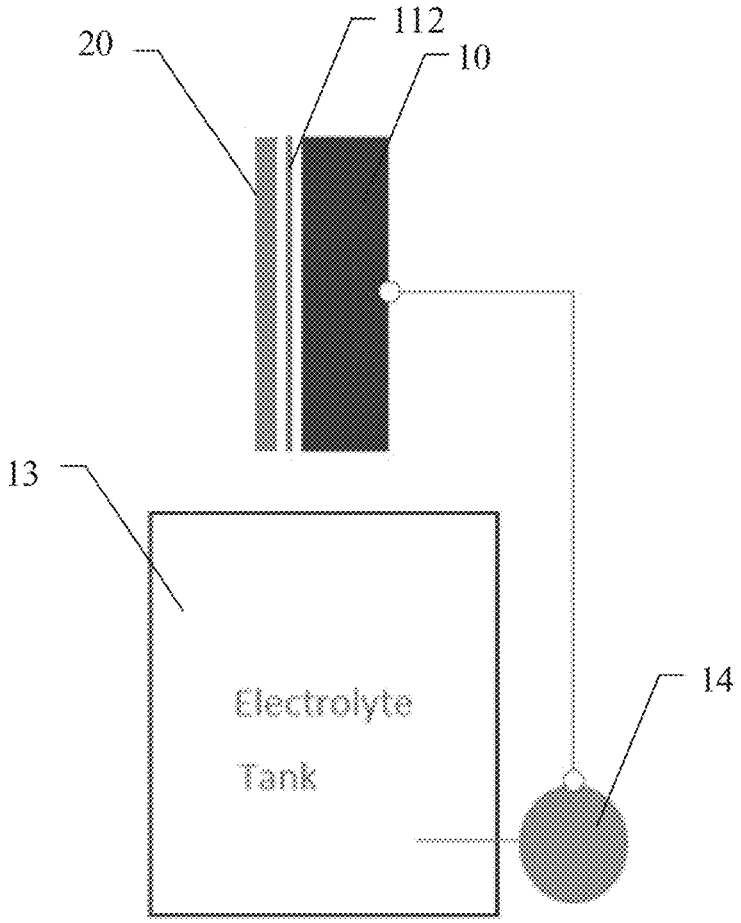
FIG. 1 is a schematic diagram of an electroplating device provided by an embodiment of the present application.
Figure 2:
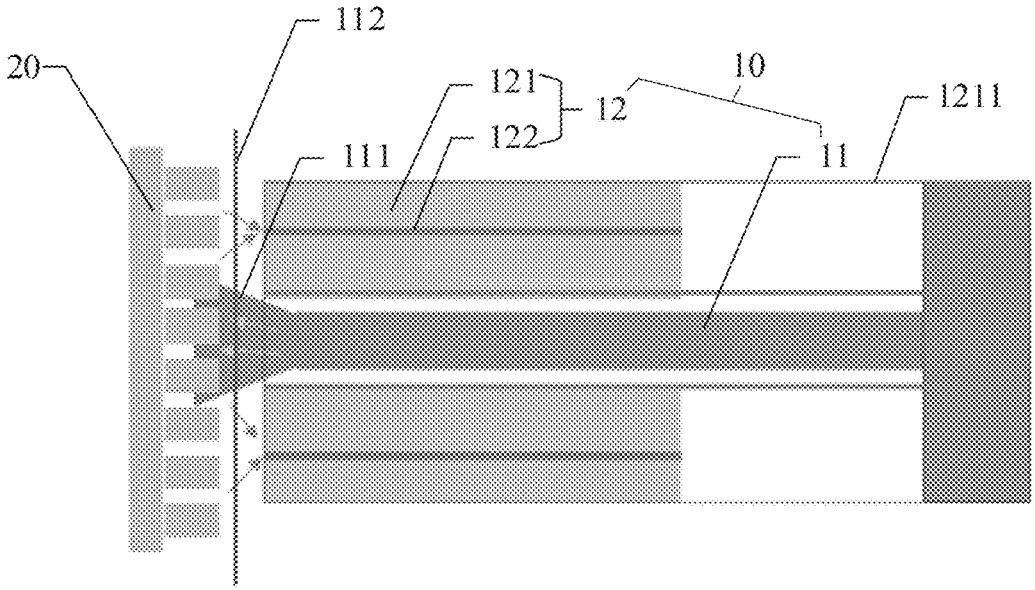
FIG. 2 is a structural view from another angle of the electroplating device provided by the embodiment of the present application.

Referring to FIGS. 1 and 2 which show structural views of an electroplating device provided by an embodiment of the present application, the electroplating device includes electroplating unit 10 for electroplating a production panel 20. The electroplating unit 10 includes an electrolyte channel 11 for jetting an electrolyte toward the production panel 20, and an electroplating assembly 12 disposed on an outer surface of the electrolyte channel 11. The electroplating assembly 12 includes an anode 121 disposed on the outer surface of the electrolyte channel 11, and a suction channel 122 provided in the anode 121 which is used for absorbing the electrolyte in a direction opposite to a jet-plating direction.

The electroplating device in this embodiment is provided with the electroplating unit 10, which includes the electrolyte channel 11, the anode 121 and the suction channel 122. The electrolyte is jetted on the production panel 20 through the electrolyte channel 11. Electrical conductivity and metal ions and the like are supplied by the anode 121, and the electrolyte jetted and plated onto the production panel 20 through the electrolyte channel 11 is absorbed by the suction channel 122.

In this embodiment, the electrolyte channel 11 and the electroplating assembly 12 are used in combination, so that the electrolyte can be uniformly electroplated on the production panel. Therefore, the quality and effect of electroplating are improved, and various requirements of the electroplating on different production panels may be met. It can be understood that the electrolyte channel 11 in this embodiment is generally configured in a cylindrical shape, and the anode 121 which has an annular shape is arranged on the outer surface of the electrolyte channel 11. Additionally, the production panel 20 described in this embodiment may be different types of production panels that need electroplating, such as PCB, substrates, circuit boards, high frequency boards, single-sided boards, double-sided boards, multilayer boards, and the like.

Figure 3:
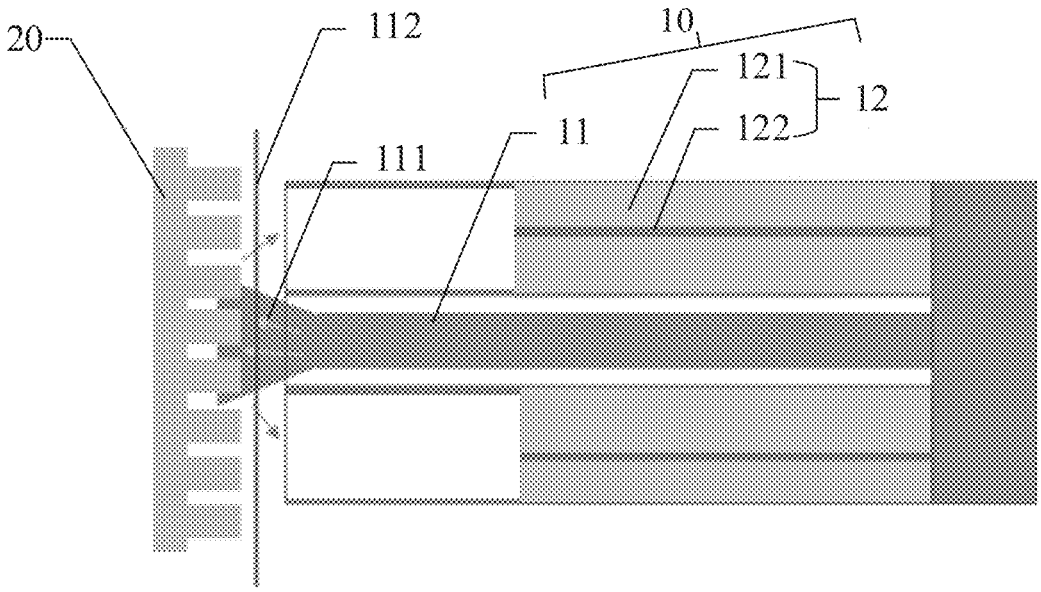
FIG. 3 is a structural view of the electroplating device being in another state provided by the embodiment of the present application.

Referring to FIGS. 2 and 3, in one embodiment, the electroplating assembly 12 is movably arranged on the outer surface of the electrolyte channel 11, in order to adjust a distance between the electroplating assembly 12 and the production panel 20.

In this embodiment, the distance between the electroplating assembly 12 and the production panel 20 is adjustable according to the size of the work piece on the production panel 20 when electroplating the production panel 20. That is, the electroplating assembly 12 can be driven to move back and forth along the direction of the electrolyte channel 11 based on specific requirements, so as to adjust the conductive effect of the anode 121 as well as the electrolyte-absorbing capability of the suction channel 122, thereby adjusting the electroplating effect.

It should be noted that when the electroplating device includes a plurality of electroplating units 10, the electroplating parameters, such as the flow rate of the electrolyte, the amount of the absorbed electrolyte, the distance between the anode 121 and the production panel 20, and the current density ($A/dm^2$/segment) of the anode 121, of each electroplating unit 10 may be set respectively according to practical requirements.

In one embodiment, the outer surface of the anode 121 is coated with a shielding coating 1211.

In this embodiment, the electroplating assembly 12 may be protected by the shielding coating 1211 (a functional coating for shielding electromagnetic waves that is made by mixing conductive particles with a chemical solvent and can be sprayed on non-metallic materials), so as to prevent interruption to the anode 121 from the external environment, which may affect the conductive effect of the anode 121.

Figure 4:
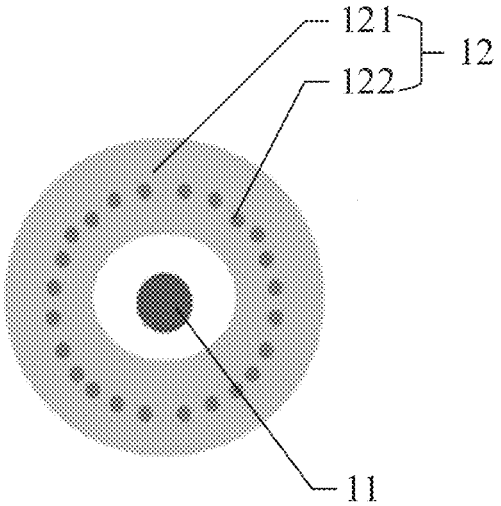
FIG. 4 is a schematic diagram of an electroplating unit in the electroplating device provided by the embodiment of the present application.

As shown in FIG. 4, in one embodiment, a plurality of suction channels 122 are provided, and the plurality of suction channels 122 are distributed at an equal interval in the anode.

In this embodiment, the plurality of suction channels 122 are arranged in the anode 121, and these suction channels 122 are distributed at an equal interval in the anode 121, in a manner similar to the anodes 121 being arranged around the electrolyte channel 11, namely the plurality of suction channels 122 are evenly spaced around the anode 121. Here, when the number of the suction channels 122 is large, the suction channels 122 may be evenly spaced in the anode in a circular arrangement, and when the number of the suction channels 122 is small, they may be evenly spaced in the anode in a rectangular arrangement (e.g. for four suction channels 122) or in a hexagonal arrangement (e.g. for six suction channels 122), and so on. That is, the arrangement of the suction channels 122 in the anode 121 may be determined by the number of the suction channels 122.

In another embodiment, one suction channel 122 is provided, and the suction channel 122 is arranged in an annular shape in the anode 121.

In this embodiment, only one suction channel 122 is provided in the anode 121, and the suction channel 122 is arranged in an annular shape in accordance with the anode 121. Apparently, in other embodiments, the suction channel 122 may also be arranged in other manners, for example, a multi-layer suction channel 122 may be arranged in an annular shape in the anode 121, and so on.

Referring back to FIGS. 1-3, in one embodiment, a diffuser 112 is disposed between the electroplating unit 10 and the production panel 20.

In this embodiment, as shown in FIGS. 2 and 3, with the diffuser 112, the electrolyte may be uniformly jetted from the electrolyte channel 11 in the electroplating unit 10, namely the electrolyte plated on the production panel 20 may be more uniform, thereby improving the quality of electroplating. In a specific embodiment, a front end of the electrolyte channel 11 (namely the end close to the production panel 20) is provided with a nozzle 111, which allows the electrolyte jetted from the electrolyte channel 11 to be more uniform. In another specific embodiment, the diffuser 112 is a diffuser mesh, which includes a plurality of round or square holes, and the like for the electrolyte to pass through. Apparently, the diffuser described in this embodiment is for ensuring a more uniform electroplating, therefore, other shielding elements allowing a uniform electroplating may also be employed.

Figure 5:
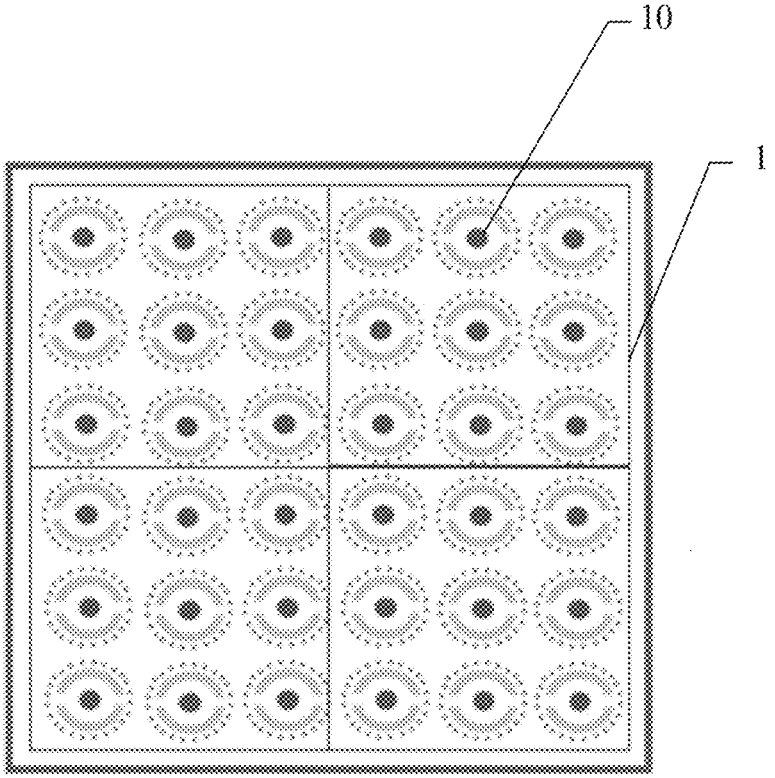
FIG. 5 is a schematic diagram of an electroplating module in the electroplating device provided by the embodiment of the present application.

In one embodiment as shown in FIG. 5, a plurality of electroplating units 10 are provided, the plurality of electroplating units 10 constitute an electroplating module 1, and a plurality of electroplating modules 1 are provided in the electroplating device.

In this embodiment, the plurality of the electroplating units 10 are formed into one electroplating module 1, and the electroplating device includes a plurality of electroplating modules 1, so that the electroplating distance, the electroplating flux, and the like, of each electroplating module 1 can be adjusted according to actual circumstances during the electroplating process. This may not only improve the electroplating efficiency, but also enhance the flexibility in industrialization and meet the needs of specific products.

In a specific embodiment, the electroplating device includes four or sixteen electroplating modules 1. Each electroplating module 1 includes nine electroplating units 10 if the electroplating device is provided with four electroplating modules 1, and each electroplating module 1 includes four electroplating units 10 if the electroplating device is provided with sixteen electroplating modules 1.

In another specific embodiment, the electroplating module 1 is formed by the electroplating units 10 arrayed in an annular shape. Apparently, in other embodiments, the electroplating module 1 may also be formed by the electroplating units 10 arrayed in other patterns, such as a triangular shape, a circular shape, and the like.

Referring back to FIG. 1, in one embodiment, the electroplating device further includes an electrolyte tank 13 and a circulating pump 14. The electrolyte tank 13 is in communication with the electrolyte channel 11. One end of the circulating pump 14 is communicated with the suction channel 122, and the other end thereof is communicated with the electrolyte tank 13.

In this embodiment, the electrolyte is transferred through the electrolyte channel 11 from the electrolytic tank 13, and is jet plated on the production panel 20. At the same time, the electrolyte jetted and plated on the production panel 20 is absorbed by the suction channel 122 and transferred back to the electrolyte tank 13 through the circulating pump 14. By repeating this process, the production panel 20 may be uniformly electroplated without wasting excess resources.

Figure 6:
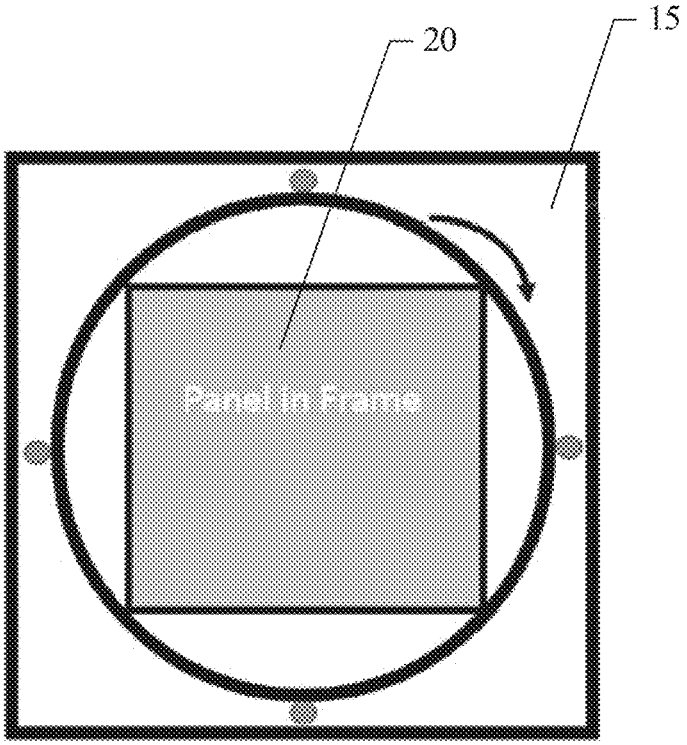
FIG. 6 is a schematic diagram of an oscillation frame in the electroplating device provided by the embodiment of the present application.

In one embodiment as shown in FIG. 6, the electroplating device further includes an oscillation frame 15 for placing the production panel 20.

In this embodiment, the production panel 20 is placed on the oscillation frame 15. Furthermore, frame oscillations on an x-axis, a y-axis, and a z-axis of the oscillation frame 15 can be individually programmed, and the rotation of the production panel 20 can be selected within each frame. The distance between the production panel 20 and the electroplating unit 10 may also be adjusted by the oscillation frame 15. In a specific embodiment, the distance between the electroplating unit 10 and the production panel 20 is less than 100 mm, and the oscillation frequency of the oscillation frame 15 is 0.1-100 Hz. The oscillation frame 15 provides a separate panel movement mode for the practical scenario of electroplating, so that a better uniformity of plating is obtained. In another specific embodiment, the oscillation frame 15 controls the production panel 20 to oscillate along a continuous S-pattern, such as a continuous S-pattern from left to right, a continuous S-pattern from right to left, or a continuous S-pattern from top to bottom and so on. The oscillation frame 15 may also control the production panel 20 to oscillate along a continuous "8"-shaped pattern, such as a continuous "8"-shaped pattern from left to right or a continuous "8"-shaped pattern from right to left and so on.

In a specific application scenario, the production panel 20 is divided into a plurality of parts, such as four parts, and each part of the production panel 20 can be independently oscillated by the oscillation frame 15.

Figure 7:
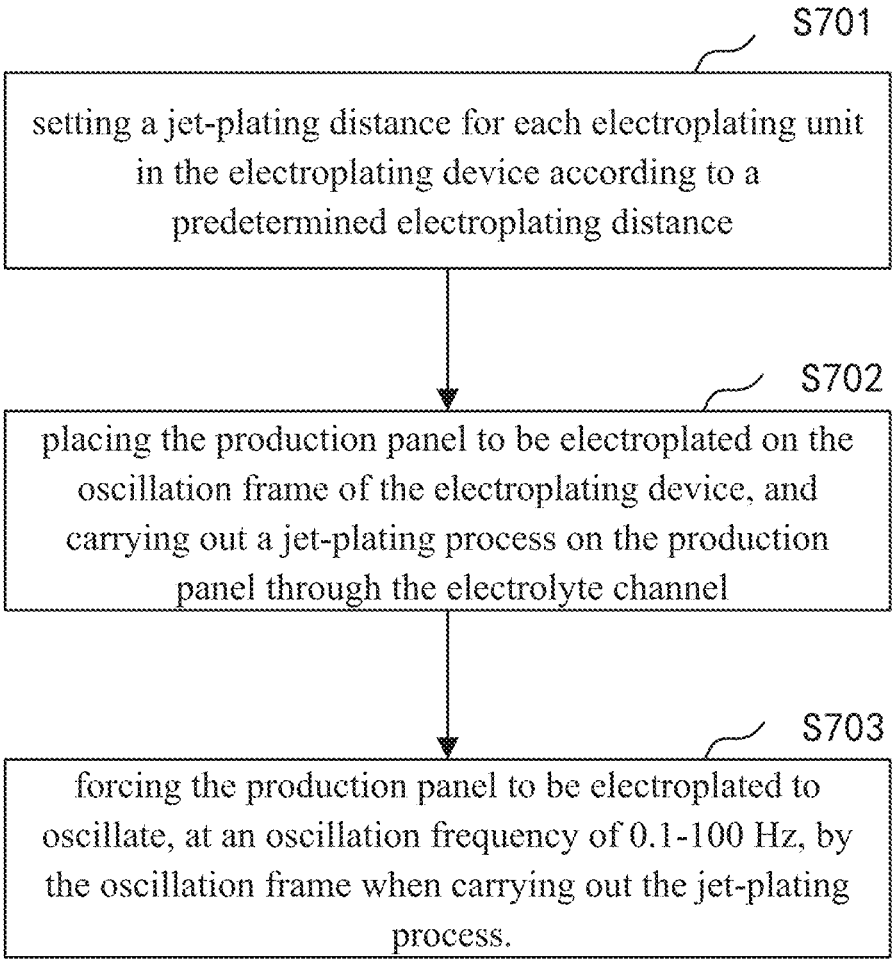
FIG. 7 is a flowchart of an electroplating method according to an embodiment of the present application.

FIG. 7 is a flowchart of an electroplating method according to an embodiment of the present application, including steps S701-S703:

S701: setting a jet-plating distance for each electroplating unit in the electroplating device according to a predetermined electroplating distance;

S702: placing the production panel to be electroplated on the oscillation frame of the electroplating device, and carrying out jet-plating of the production panel through the electrolyte channel;

S703: forcing the production panel to be electroplated to oscillate, at an oscillation frequency of 0.1-100 Hz, by the oscillation frame when carrying out the jet-plating.

Since the embodiments of the method correspond to the embodiments of the device, the embodiments of the method may be referred to the description of the embodiments of the device, and will not be repeated herein.

The various embodiments in the description are described in a progressive manner, with each embodiment focusing on the differences from other embodiments, and the same and similar parts between the various embodiments can be referred to each other. Since the system disclosed in the embodiment corresponds to the method disclosed in the embodiment, it is therefore briefly described, and the relevant part can be referred to the description of the method. It should be noted that for those of ordinary skill in the art, without departing from the principles of the present application, several improvements and modifications can also be made to the present application, and these improvements and modifications shall fall within the scope of protection of the claims of the present application.

It should also be noted that, in the present description, relational terms such as first and second, etc. are merely used to distinguish one entity or operation from another entity or operation, and do not necessarily require or imply practical relationship or sequence between these entities or operations. Moreover, the terms "including", "comprising" or any other variation thereof are intended to encompass a non-exclusive inclusion such that a process, method, article or apparatus comprising a list of elements includes not only those elements, but also includes other elements not explicitly listed or inherent to such a process, method, article or apparatus. Unless otherwise limited, an element defined by "comprising a . . . " does not preclude the presence of additional identical elements in the process, method, article, or apparatus that includes the element.

What is claimed is:

1. An electroplating device, comprising an electroplating unit for electroplating a production panel, the electroplating unit comprising:

only one electrolyte channel for jetting an electrolyte toward the production panel, and an electroplating assembly disposed on an outer surface of the electrolyte channel, wherein the electroplating assembly comprises an anode disposed on the outer surface of the electrolyte channel, and a suction channel arranged around the electrolyte channel and provided in the anode which is used for absorbing an electrolyte in a direction opposite to a jet-plating direction, wherein the electroplating assembly is movably disposed on the outer surface of the electrolyte channel to adjust a distance between the electroplating assembly and the production panel.

2. The electroplating device according to claim 1, wherein an outer surface of the anode comprises a shielding coating contacting the whole outer surface of the anode.

3. The electroplating device according to claim 1, wherein a plurality of suction channels are provided, and the plurality of suction channels are disposed at an equal interval in the anode.

4. The electroplating device according to claim 1, wherein one suction channel is provided, and the one suction channel is configured in an annular shape in the anode.

5. The electroplating device according to claim 1, wherein a diffuser is disposed between the electroplating unit and the production panel.

6. The electroplating device according to claim 1, further comprising a plurality of electroplating modules, and each one of the plurality of electroplating modules consisting of a plurality of electroplating units.

7. The electroplating device according to claim 1, further comprising an electrolyte tank and a circulating pump, the electrolyte tank being in communication with the electrolyte channel, one end of the circulating pump being communicated with the suction channel, and the other end of the circulating pump being communicated with the electrolyte tank.

8. The electroplating device according to claim 1, further comprising an oscillation frame for placing the production panel.

9. An electroplating method using the electroplating device according to claim 1, comprising:

setting a jet-plating distance for the electroplating unit in the electroplating device according to a predetermined electroplating distance;

placing the production panel to be electroplated on an oscillation frame of the electroplating device, and carrying out jet-plating of the production panel through the electrolyte channel; and forcing the production panel to be electroplated to oscillate, at an oscillation frequency of 0.1-100 Hz, by the oscillation frame when carrying out the jet-plating.

10. The electroplating method according to claim 9, wherein an outer surface of the anode is coated with a shielding coating.

11. The electroplating method according to claim 9, wherein a plurality of suction channels are provided, and the plurality of suction channels are disposed at an equal interval in the anode.

12. The electroplating method according to claim 9, wherein the number of the suction channel is one, and the suction channel is configured in an annular shape in the anode.

13. The electroplating method according to claim 9, wherein a diffuser is disposed between the electroplating unit and the production panel.

14. The electroplating method according to claim 9, the electroplating device further comprising a plurality of electroplating modules, and each one of the plurality of electroplating modules consisting of a plurality of electroplating units.

15. The electroplating method according to claim 9, the electroplating device further comprising an electrolyte tank and a circulating pump, the electrolyte tank being in communication with the electrolyte channel, one end of the circulating pump being communicated with the suction channel, and the other end of the circulating pump being communicated with the electrolyte tank.

* * * * *